US012258652B2

(12) United States Patent
Yang et al.

(10) Patent No.: US 12,258,652 B2
(45) Date of Patent: Mar. 25, 2025

(54) METHOD FOR SMELTING HIGH-TEMPERATURE ALLOY WITH ULTRAHIGH N CONTENT IN VIM FURNACE

(71) Applicant: DAYE SPECIAL STEEL CO., LTD., Hubei (CN)

(72) Inventors: Xiaoli Yang, Hubei (CN); Li Wang, Hubei (CN); Yinghua Lei, Hubei (CN); Zhicheng Zhang, Hubei (CN); Linsen Li, Hubei (CN); Zheng Cao, Hubei (CN); Shoulei Gao, Hubei (CN); Xiaolei Zhang, Hubei (CN)

(73) Assignee: DAYE SPECIAL STEEL CO., LTD., Hubei (CN)

( * ) Notice: Subject to any disclaimer, the term of this patent is extended or adjusted under 35 U.S.C. 154(b) by 0 days.

(21) Appl. No.: 18/563,262

(22) PCT Filed: May 25, 2022

(86) PCT No.: PCT/CN2022/095043
§ 371 (c)(1),
(2) Date: Nov. 21, 2023

(87) PCT Pub. No.: WO2022/218444
PCT Pub. Date: Oct. 20, 2022

(65) Prior Publication Data

US 2024/0271252 A1 Aug. 15, 2024

(30) Foreign Application Priority Data

May 24, 2021 (CN) ..... 202110567765.3

(51) Int. Cl.
*C22C 1/02* (2006.01)
*C22C 30/02* (2006.01)

(52) U.S. Cl.
CPC ..... *C22C 1/02* (2013.01); *C22C 30/02* (2013.01)

(58) Field of Classification Search
None
See application file for complete search history.

(56) References Cited

U.S. PATENT DOCUMENTS

| | | | | |
|---|---|---|---|---|
| 4,421,571 | A | 12/1983 | Kudo et al. | |
| 5,077,006 | A * | 12/1991 | Culling | C22C 30/00 420/451 |
| 6,391,479 | B1 * | 5/2002 | Wood | C22C 30/00 428/653 |
| 2015/0367455 | A1 | 12/2015 | Reydet et al. | |

FOREIGN PATENT DOCUMENTS

| | | | |
|---|---|---|---|
| CN | 1563462 | A | 1/2005 |
| CN | 101205586 | A | 6/2008 |
| CN | 101372721 | A | 2/2009 |
| CN | 101928869 | A | 12/2010 |
| CN | 102400030 | A | 4/2012 |
| CN | 102747297 | A | 10/2012 |
| CN | 103173692 | A | 6/2013 |
| CN | 103233174 | A | 8/2013 |
| CN | 103924031 | A | 7/2014 |
| CN | 104593692 | A | 5/2015 |
| CN | 105026590 | A | 11/2015 |
| CN | 110872653 | A | 3/2020 |
| CN | 113278834 | A | 8/2021 |
| JP | 2003136202 | A | 5/2003 |
| KR | 20180114640 | A | 10/2018 |

OTHER PUBLICATIONS

International Search Report of the corresponding International Application No. PCT/CN2022/095043, dated Aug. 24, 2022.
Ren Yi-Bin et al., Factors affecting the smelting of high nitrogen steel in vacuum induction melting furnace published in the Journal of Materials and Metallurgy. Mar. 2004; vol. 3 No. 1; China Academic Journal Electronic Publishing House.
Hastelloy alloy: the best choice to solve the corrosion problem of hazardous waste treatment equipment (high-temperature corrosion part); the Shanghai Chemical Industry; Sep. 2005; vol. 30 No. 9: pp. 51-52.

* cited by examiner

*Primary Examiner* — Brian D Walck
(74) *Attorney, Agent, or Firm* — Global IP Counselors, LLP

(57) ABSTRACT

Disclosed in the present disclosure is a method for smelting a high-temperature alloy with an ultrahigh N content in a VIM furnace, and a high-temperature alloy with an ultrahigh N content. The VIM-furnace smelting method comprises a smelting step performed in a VIM furnace, and a casting step, wherein at a later stage of smelting, a nitrogen-containing substance is added to the VIM furnace to adjust the content of N. In the present disclosure, by comprehensively improving the raw materials, the smelting process, etc., the yield of N during a VIM-furnace smelting process is increased and accurate control over the content of N in the high-temperature alloy is achieved, such that a target content of nitrogen can be guaranteed, and an ideal product can thus be obtained.

7 Claims, No Drawings

METHOD FOR SMELTING HIGH-TEMPERATURE ALLOY WITH ULTRAHIGH N CONTENT IN VIM FURNACE

CROSS-REFERENCE TO RELATED APPLICATION

This application is a U.S. National Stage application of International Application No. PCT/CN2022/095043, filed on May 25, 2022, which claims priority to Chinese Application No. 202110567765.3, filed on May 24, 2021, the contents of each of which am hereby incorporated by reference in their entirety.

TECHNICAL FIELD

The disclosure belongs to the field of vacuum smelting of the high-temperature alloy in the metallurgical industry, and specifically relates to a smelting method of the high-temperature alloy with ultra-high N-content in a VIM furnace (method for smelting high-temperature alloy with ultrahigh N content in VIM furnace).

BACKGROUND

The high-temperature alloy with ultra-high N-content is a kind of material commonly used in power plants and is mostly used to manufacture forgings, rings and other products. Affected by the application environments and the special requirements for alloy purity, the smelting of this alloy have to be proceeded in a VIM furnace. In the process of smelting the high-temperature alloy with ultra-high N-content in a VIM furnace, under high vacuum conditions, the nitrogen element is prone to volatilize with the vacuum system, and the ideal target value cannot be obtained. In the high vacuum environment of the VIM, it is usually impossible to effectively control the ultra-high content of the N element, so that the yield rate obtained by the traditional smelting process is very low.

SUMMARY

In view of the deficiencies and defects of the conventional technology, one of the objects of the present disclosure is to provide a smelting method of the high-temperature alloy with ultra-high N-content in a VIM furnace (which can also be said to be: a control method for accurately controlling the N content in the process of smelting the high-temperature alloy with ultra-high N content in a VIM furnace). The method can ensure the target content of nitrogen element and greatly improve the yield rate of product.

The technical solutions adopted by the present disclosure to solve the technical problems am as follows:

A smelting method of the high-temperature alloy with ultra-high N content in a VIM furnace including a smelting step carried out in a VIM furnace and a casting step; and in the later stage of the smelting, nitrogen-containing substances are added to the VIM furnace to adjust the N content, wherein the VIM furnace is a vacuum induction melting furnace.

In the above-mentioned smelting method of the high-temperature alloy with ultra-high N content in a VIM furnace, as a preferred embodiment, the mass percentage of N in the high-temperature alloy with ultra-high N content is 1500-3000 ppm, preferably 2000-3000 ppm, and more preferably 2700-3000 ppm; that is, the N content in the high-temperature alloy with ultra-high N content obtained after the casting step is 1500-3000 ppm, preferably 2000-3000 ppm, and more preferably 2700-3000 ppm.

In the above-mentioned smelting method of the high-temperature alloy with ultra-high N content in a VIM furnace, as a preferred embodiment, the nitrogen-containing substances am nitrogen-containing alloys with a nitrogen mass percentage of more than 3%; further preferably at least one of ferrochromium nitride, manganese nitride and aluminum nitride; preferably, the nitrogen-containing substances (such as ferrochromium nitride) are baking treated nitrogen-containing substances; wherein, more preferably, the baking temperature is 750-1100° C., and the baking time is ≥6 hours. Compared with the technical solutions in which the nitrogen-containing substances (such as ferrochromium nitride) are usually not baking treated, the nitrogen-containing substances (such as ferrochromium nitride) are innovatively baking treated in the present disclosure to remove the gases in the nitrogen-containing substances (mainly to remove H), to reduce the temperature difference between the nitrogen-containing substances and the liquid molten steel, and to avoid violent reactions that affect the yield of N. More preferably, the equipment for carrying out the baking treatment and the VIM furnace are in the same plant. In the method, if the temperature is lower than 750° C., the effect of removing H may be insufficient, and if the temperature is above 1100° C., a part of the N dissolved in the ferrochromium nitride may be decomposed. It may ultimately affect the yield of N; and the baking time is preferably more than 6 hours to achieve the effect of removing H.

In the above-mentioned smelting method of the high-temperature alloy with ultra-high N content in a VIM furnace, as a preferred embodiment, in the later stage of the smelting, before the addition of the nitrogen-containing substances (such as ferrochromium nitride), inert gases am introduced into the VIM furnace, preferably, the inert gas is preferably argon gas, the pressure of the argon gas in the VIM furnace is ≥10000 pa; and the pressure of the argon gas is set to be as large as possible within the endurance range of the equipment. If the pressure of the argon gas is too low, the N content of the product alloy may not meet the requirements, and the N yield after the addition of the nitrogen-containing substances (such as ferrochromium nitride) may be decreased, because the vacuum system of the vacuum induction furnace is in a dynamic balance process, wherein a part of the N may be removed out of the furnace with the vacuum system, so that it is required to be supplemented through more nitrogen-containing substances (such as ferrochromium nitride), resulting in increased costs or the final composition being unqualified and discarded. If the argon gas is filled with a higher pressure, a compressive stress is acted on the liquid molten steel surface, and the resistance to discharge from the liquid surface of the N brought into the liquid molten steel by nitrogen-containing substances (such as ferrochromium nitride) is forced to increase. At the same time, the increased pressure in the furnace can also slow down the dynamic balance process of the system. Preferably, the introduction of the inert gases continues until the end of the casting.

Preferably, the smelting includes a melting period and a refining period, and the later stage of the smelting refers to the later stage of the refining.

In the above-mentioned smelting method of the high-temperature alloy with ultra-high N content in a VIM furnace, as a preferred embodiment, the time from the adding of the nitrogen-containing substances (such as ferrochromium nitride) to the start of the casting is no more than 15 minutes. If the time from the adding of the nitrogen-containing substances (such as ferrochromium nitride) to the start of the casting is too long, the yield of N in the alloy may be reduced.

In the above-mentioned smelting method of the high-temperature alloy with ultra-high N content in a VIM furnace, as a preferred embodiment, in the smelting step, when raw materials am added to the VIM furnace before the smelting, the added amount of metallic chromium is 80-85% of the total mass of all the metallic chromium raw materials; the remaining 15-20% of the metallic chromium is added according to the required amount before the introduction of the inert gas in the later stage of the smelting to adjust the composition.

In the above-mentioned smelting method of the high-temperature alloy with ultra-high N content in a VIM furnace, the high-temperature alloy with ultra-high N content of the present disclosure is a kind of metal material based on iron and nickel, which can work continuously at a high temperature above 600° C., preferably a kind of metal material that can work for a long time under stress.

In the above-mentioned smelting method of the high-temperature alloy with ultra-high N content in a VIM furnace, as a preferred embodiment, the composition of the high-temperature alloy with ultra-high N content is as follows in terms of mass percentage: C: 0.02-0.10%; Cr: 23.00-27.00%; Ni: 35.00-39.00%; W: ≤0.50%; Mo: ≤1.00%; P: ≤0.04%; S: ≤0.03%; Mn: ≤1.50%; Si: ≤1.00%; B: ≤0.01%; Nb: 0.40-0.90%; Co: ≤3.00%; N: 0.15-0.30%; Al: ≤0.40%; Ti: ≤0.20%; Cu: ≤0.50%; and Fe: remain.

A high-temperature alloy with ultra-high N content, the high-temperature alloy with ultra-high N content is prepared by the above-mentioned smelting method of the high-temperature alloy with ultra-high N content in a VIM furnace.

The technical principle of obtaining the ideal target N content in a high vacuum condition by the VIM smelting of the present disclosure is: the fixed nitrogen content in ferrochromium nitride is much greater than that in other alloy raw materials, so ferrochromium nitride is used as the entraining media of the N element in the high-temperature alloy. However, it is very difficult to effectively and precisely control the nitrogen content, since the VIM is a smelting process in a high vacuum condition and the N element may be removed out of the furnace in a free state with the vacuum system. Therefore, in the present disclosure, through controlling the timing of the adding of ferrochromium nitride (which is added in the later stage of the refining); controlling the addition conditions (introduction into high-pressure inert gases before the addition of ferrochromium nitride to increase the yield of N element); and controlling the time from the adding of the ferrochromium nitride to the casting, high-temperature alloy products with ideal target values are obtained under the condition that the ingots are formed through the casting with the yield of N element being ensured.

Compared with the conventional technology, the present disclosure has the following positive effects:

(1) The method of the present disclosure is simple, easy to implement and effective, and does not require the addition of special equipment and tooling.

(2) In the present disclosure (high-temperature alloy, the alloy ratio thereof is much higher than that of steel), through comprehensive improvements to the raw materials, the smelting processes and the like, the yield of N element in the smelting process in VIM furnaces is increased, the precise control of the N element content of the high-temperature alloy is achieved, and the target content of nitrogen element can be thus ensured and ideal products can be obtained.

(3) In the present disclosure, the problems of the yield of N element in a high vacuum condition are effectively solved, the yield rate of the products such as rings is improved, and the production cost of manufacturing enterprises is reduced.

(4) In the present disclosure, through the reasonably baking treatment of the ferrochromium nitride, the yield of nitrogen element can be ensured, and at the same time, the amount of H entrained into the molten steel along with the moisture in the ferrochromium nitride is reduced.

(5) In the present disclosure, through the introduction of Ar gas in a pressure above 10000 Pa, and the original high vacuum condition being thus transformed to a high pressure condition, the liquid molten steel surface is under intensive compressive stress, which can enhance the solubility of N in the liquid molten steel and further increase the yield.

(6) In the present disclosure, in addition, after the introduction of argon, through the control of the time from the addition of ferrochromium nitride to casting, the yield of N can be ensured and the occurrence of heterometallic inclusion defects due to incomplete melting of ferrochromium nitride is prevented.

DETAILED DESCRIPTION OF THE EMBODIMENTS

In order to highlight the purpose, technical solutions and advantages of the present disclosure, the present disclosure will be further described below in combination with the examples which am illustrated by way of explanation of the disclosure rather than limiting the present disclosure. The technical solutions of the present disclosure are not limited to the specific embodiments listed below, but also include any combination of the specific embodiments.

The ferrochromium nitride of the present disclosure can be any brand of ferrochromium nitride with a nitrogen content of more than 3 wt %. In the following examples, ferrochromium nitride with the brand name FeNCr3-A is used as an example for illustration.

Example 1

In the example 1 of the present disclosure, a VIM furnace with a nominal capacity of 6 tons is used for smelting the high-temperature alloy with ultra-high N content, comprising the following steps:

Step 1, Ferrochromium nitride baking: Ferrochromium nitride is baked in a high-temperature annealing furnace in the plant.

In the step, the parameters for baking the ferrochromium nitride comprise: N content (i.e., the mass percentage of N in ferrochromium nitride): 5.1%; baking (heating) temperature: 930° C.; baking time: 8.5 hours.

Step 2, Charging before the smelting: Ni, Fe, Nb, Cr and other raw materials are successively charged into the VIM furnace; 100% of the ferrochromium nitride is reserved without addition; and 20% of the metallic chromium is reserved without addition.

Step 3, Smelting process: The raw materials are smelted (including a melting period and a refining period, wherein the indication for the completion of the melting period is the monitored full melting temperature of 1530° C., and the temperature of the refining period is 1510° C., and the time thereof is 130 minutes), in which, in the later stage of the refining period, the required amount of metallic chromium is added to adjust the composition, and afterwards, in the later stage of the refining, argon gas is introduced into the furnace so that the argon pressure in the furnace of 10,000 pa is achieved. Then ferrochromium nitride is added to adjust the N content.

Step 4, Casting process: The liquid molten steel obtained from the smelting process is cast, in which the time from the adding of ferrochromium nitride to the start of casting (steel tapping) is 14 minutes.

Step 5, Inspection: The composition content of the cast (wt %) is inspected according to the standard requirements, C: 0.061%; Cr 25.40%; Ni: 37.03%; P: 0.006%; S: 0.002%; Mn: 0.74%; Si: 0.470%; B: ≤0.01%; Nb: 0.63%; N: 0.2857%; Al: 0.230%; Ti: 0.05%; Cu: 0.01%; H: 0.0001%.

The yield of nitrogen (i.e., nitrogen yield which is the ratio of the nitrogen content in the obtained product to the content of the nitrogen entrained from the raw materials used) and yield rate are 76.92% and 100%, respectively.

Example 2

In the example 2 of the present disclosure, a VIM furnace with a nominal capacity of 6 tons is used for smelting the high-temperature alloy with ultra-high N content, comprising the following steps:

Step 1, Ferrochromium nitride baking: Ferrochromium nitride is baked in a high-temperature annealing furnace in a plant.

In the step, the parameters for baking the ferrochromium nitride comprise: N content: 5.1%; baking (heating) temperature: 930° C.; baking time: 8.0 hours.

Step 2, Charging before the smelting: Ni, Fe, Nb, Cr and other raw materials are successively charged into the VIM furnace; 100% of the ferrochromium nitride is reserved without addition; and 20% of the metallic chromium is reserved without addition.

Step 3, Smelting process: The raw materials am smelted (including a melting period and a refining period, wherein the indication for the completion of the melting period is the monitored full melting temperature of 1533° C., and the temperature of the refining period is 1510° C., and the time thereof is 130 minutes), wherein, in the smelting process, the required amount of metallic chromium is added to adjust the composition, and afterwards, in the later stage of the refining, argon gas is introduced to a pressure of 10000 pa. Then ferrochromium nitride is added to adjust the N content.

Step 4, Casting process: The liquid molten steel obtained from the smelting process is cast, in which the time from the addition of ferrochromium nitride to the start of casting (steel tapping) is 15 minutes.

Step 5, Inspection: The composition content of the cast (wt %) is inspected according to the standard requirements, C: 0.060%; Cr 25.60%; Ni: 37.00%; P: 0.005%; S: 0.001%; Mn: 0.76%; Si: 0.440%; Nb: 0.63%; N: 0.2893%; Al: 0.250%; Ti: 0.04%; Cu: 0.01%; H: 0.0001%.

The yield of nitrogen and yield rate am 76.90% and 100%, respectively.

Example 3

The Example 3 is carried out similarly to the Example 1, except that the baking temperature of the ferrochromium nitride is set to 800° C.

Step 5, Inspection: The composition content of the cast (wt %) is inspected according to the standard requirements, C: 0.061%; Cr 25.30%; Ni: 37.05%; P: 0.005%; S: 0.002%; Mn: 0.75%; Si: 0.500%; B: ≤0.01%; Nb: 0.65%; N: 0.2937%; Al: 0.250%; Ti: 0.05%; Cu: 0.01%; H: 0.00015%.

The yield of nitrogen and yield rate am 76.70% and 100%, respectively.

Example 4

The Example 4 is carried out similarly to the Example 1, except that the baking temperature of ferrochromium nitride is 1050° C.

Step 5: Inspection: The composition content of the cast (wt %) is inspected according to the standard requirements, C: 0.059%; Cr 25.33%; Ni: 37.00%; P: 0.004%; S: 0.001%; Mn: 0.70%; Si: 0.480%; B: ≤0.01%; Nb: 0.62%; N: 0.2900%; Al: 0.250%; Ti: 0.04%; Cu: 0.01%; H: 0.00015%

The yield of nitrogen and yield rate am 76.80% and 100%, respectively.

Comparative Example 1

The Comparative Example 1 is carried out similarly to the Example 1, except that the baking temperature of ferrochromium nitride is 650° C.

Step 5: Inspection: The composition content of the cast (wt %) is inspected according to the standard requirements, C: 0.061%; Cr 25.35%; Ni: 37.01%; P: 0.005%; S: 0.001%; Mn: 0.72%; Si: 0.500%; B: ≤0.01%; Nb: 0.65%; N: 0.2955%; Al: 0.250%; Ti: 0.05%; Cu: 0.01%; H: 0.00035% (the lower the H content during the application of the alloy is, the better results are obtained. If it is too high, the durability and fatigue life may be affected in the application of users).

The yield of nitrogen is 76.80%.

Comparative Example 2

The Comparative Example 2 is carried out similarly to the Example 1, except that the baking temperature of ferrochromium nitride is 1200° C.

Step 5, Inspection: The composition content of the cast (wt %) is inspected according to the standard requirements, C: 0.060%; Cr 25.30%; Ni: 37.05%; P: 0.005%; S: 0.001%; Mn: 0.72%; Si: 0.460%; B: ≤0.01%; Nb: 0.60%; N: 0.2890%; Al: 0.250%; Ti: 0.05%; Cu: 0.01%; H: 0.00009%.

The yield of nitrogen is 63.34%.

Comparative Example 3

The Comparative Example 3 is carried out similarly to the Example 1, except that the argon gas is introduced so that the pressure in the furnace of 9000 Pa is achieved.

Step 5, Inspection: The composition content of the cast (wt %) is inspected according to the standard requirements, C: 0.059%; Cr 25.33%; Ni: 37.10%; P: 0.005%; S: 0.001%; Mn: 0.70%; Si: 0.510%; B: ≤0.01%; Nb: 0.66%; N: 0.2910%; Al: 0.260%; Ti: 0.06%; Cu: 0.01%; H: 0.0001%.

The yield of nitrogen and yield rate are 74.38% and 100%, respectively.

Comparative Example 4

The Comparative Example 4 is carried out similarly to the Example 1, except that the time from the addition of ferrochromium nitride to the steel tapping is 17 minutes.

The composition content of the cast (wt %) is inspected according to the standard requirements, C: 0.062%; Cr 25.28%; Ni: 37.15%; P: 0.005%; S: 0.001%; Mn: 0.60%; Si: 0.500%; B: ≤0.01%; Nb: 0.67%; N: 0.2913%; Al: 0.250%; Ti: 0.06%; Cu: 0.01%; H: 0.0001%.

The yield of nitrogen and yield rate are 75.80% and 100%, respectively.

Comparative Example 5

The Comparative Example 5 is carried out similarly to the Example 1, except that the step 1 in the Example 1, that is, the step of baking the ferrochromium nitride, is omitted.

The composition content of the cast (wt %) is inspected according to the standard requirements, C: 0.059%; Cr 25.30%; Ni: 37.20%; P: 0.005%; S: 0.001%; Mn: 0.68%; Si: 0.520%; B: ≤0.01%; Nb: 0.68%; N: 0.2910%; Al: 0.250%; Ti: 0.06%; Cu: 0.01%; H: 0.0005%.

A large amount of H element is brought into the alloy by the chromium nitride due to the fact that the chromium nitride is not baked, and accordingly, the content of H element in the alloy is too high and the alloy obtained is thus a waste product.

The yield of nitrogen and yield rate are 76.15% and 0.0%, respectively.

Comparative Example 6

The Comparative Example 6 is carried out similarly to the Example 1, except that the procedure of introducing argon gas into the furnace during the smelting process in the Example 1 is omitted, that is, no argon gas is introduced in the later stage of the refining.

The composition content of the cast (wt %) is inspected according to the standard requirements, C: 0.059%; Cr 25.34%; Ni: 37.15%; P: 0.005%; S: 0.001%; Mn: 0.71%; Si: 0.520%; B: ≤0.01%; Nb: 0.65%; N: 0.1010%; Al: 0.270%; Ti: 0.06%; Cu: 0.01%; H: 0.0001%.

In the case of no argon gas being introduced, after the ferrochromium nitride added to the furnace is melted and decomposed, a part of the nitrogen element is removed out of the furnace in the form of $N_2$ in free state with the vacuum system in a high vacuum condition. As a result, the yield of nitrogen element is very low, and the nitrogen element in the alloy cannot meet the standard requirements and eventually is a waste product.

The yield of nitrogen and yield rate am 33.34% and 0.0%, respectively.

The invention claimed is:

1. A smelting method of an alloy with ultra-high N-content in a VIM furnace, characterized in that the smelting method in a VIM furnace comprises a smelting step carried out in a VIM furnace and a casting step;

the smelting step comprises a melting period and a refining period, and the later stage of the smelting refers to the later stage of the refining; and in the later stage of the smelting, nitrogen-containing substances are added to the VIM furnace to adjust the N content;

the nitrogen-containing substances are baking treated nitrogen-containing substances, wherein the baking temperature is 750-1100° C., and the baking time is ≥6 hour;

in the later stage of the smelting, before the addition of the nitrogen-containing substances, inert gases are introduced into the VIM furnace, wherein, the time from the addition of the nitrogen-containing substances to the start of the casting is 14-15 minutes, the inert gas is argon gas, and the pressure of the argon gas in the VIM furnace is ≥10000 pa, in the smelting step, when raw materials are added to the VIM furnace before the smelting, the added amount of metallic chromium is 80-85% of the total mass of all the metallic chromium raw materials; the remaining 15-20% of the metallic chromium is added according to the required amount before the introduction of the inert gas in the later stage of the smelting to adjust the composition;

the composition of the alloy with ultra-high N content is as follows in terms of mass percentage: C: 0.02-0.10%; Cr: 23.00-27.00%; Ni: 35.00-39.00%; W: ≤0.50%; Mo: ≤1.00%; P: ≤0.04%; S: ≤0.03%; Mn: ≤1.50%; Si: ≤1.00%; B: ≤0.01%; Nb: 0.40-0.90%; Co: ≤3.00%; N: 0.15-0.30%; Al: ≤0.40%; Ti: ≤0.20%; Cu: ≤0.50%; and Fe: balance.

2. The smelting method in a VIM furnace of claim 1, characterized in that the mass content of N in the alloy with ultra-high N content is 2000-3000 ppm.

3. The smelting method in a VIM furnace of claim 2, characterized in that the mass content of N in the alloy with ultra-high N content is 2700-3000 ppm.

4. The smelting method in a VIM furnace of claim 1, characterized in that the nitrogen-containing substances are nitrogen-containing alloys with a nitrogen mass percentage of more than 3%.

5. The smelting method in a VIM furnace of claim 4, characterized in that the nitrogen-containing substances are at least one of ferrochromium nitride, manganese nitride and aluminum nitride.

6. The smelting method in a VIM furnace of claim 5, characterized in that the equipment for carrying out the baking treatment and the VIM furnace are in the same plant.

7. The smelting method in a VIM furnace of claim 1, characterized in that the introduction of the inert gases continues until the end of the casting.

* * * * *